United States Patent [19]

Hsu

[11] Patent Number: 4,820,226

[45] Date of Patent: Apr. 11, 1989

[54] GETTER PUMP FOR HYDROGEN AND HYDROCARBON GASES

[75] Inventor: Wen L. Hsu, Danville, Calif.

[73] Assignee: The United States of America as represented by the United States Department of Energy, Washington, D.C.

[21] Appl. No.: 108,326

[22] Filed: Oct. 14, 1987

[51] Int. Cl.[4] ..... H01J 41/16; H01J 41/12

[52] U.S. Cl. ..... 445/55; 417/49; 417/51

[58] Field of Search ..... 445/55; 417/49, 51

[56] References Cited

U.S. PATENT DOCUMENTS

| | | | |
|---|---|---|---|
| 3,217,973 | 11/1965 | Knauer | 417/49 |
| 3,221,197 | 11/1965 | Coppola | 417/51 X |
| 3,249,291 | 5/1966 | Ackley | 417/49 |
| 3,332,606 | 7/1967 | Holland | 417/49 |
| 4,645,468 | 2/1987 | Kroonte | 445/55 |

*Primary Examiner*—Kenneth J. Ramsey

*Attorney, Agent, or Firm*—Armand McMillan; James H. Chafin; Judson R. Hightower

[57] ABSTRACT

A gettering device for hydrogen isotopes and gaseous hydrocarbons based on the interaction of a plasma and graphite used as cathodic material. The plasma is maintained at a current density within the range of about 1 to about 1000 mA/cm$^2$. The graphite may be heated to a temperature greater than 1000° C. The new device offers high capacity, low noise, and gas species selectivity.

11 Claims, 2 Drawing Sheets

HYDROGEN PUMPING BY GRAPHITE

HYDROGEN PUMPING BY GRAPHITE

GETTER PUMP FOR HYDROGEN AND HYDROCARBON GASES

The U.S. Government has rights in this invention pursuant to Contract No. DE-AC04-76DP00789 between the U.S. Department of Energy and AT&T Technologies, Inc.

BACKGROUND OF THE INVENTION

This invention relates to the gettering of hydrogen and other gases. It further relates to the use of the process in fusion devices.

The art provides numerous methods for gettering or pumping hydrogen gas. One of the techniques often employed for this purpose is to coat a gettering material on the inside surface of a vessel from within which hydrogen is to be removed. Typically, the material is heated to a few hundred degrees to activate its sorbing capacity. Sometimes, the pumping or sorbing capability of the gettering material deteriorates when non-compatible gases are present in the system. Another approach is to incorporate a gettering material in a porous structural material, a polymeric foam for insurance, so that hydrogen capture may occur over a long period of time and prevent damage to an electronic or other type of device that has to be stored for an intermediate period.

Thus, a gettering material formed by coating a Group VIII metal hydrogenation catalyst with certain unsaturated organic materials such as dimerized benzylacetylene (Anderson et al, U.S. Pat. No. 3,963,826) and then using such coated material in a closed volume to getter hydrogen (Anderson et al, U.S. Pat. No. 3,896,042). Catalytic nickel has been used to dissociate hydrocarbons and active zirconium-aluminum alloys employed to sorb the resultant hydrogen while the carbon formed is deposited on the catalyst (Young, U.S. Pat. No. 4,515,528). Supported getters have been disclosed which comprise a three-dimensional titanium or nickel structure defining up to 100 interconnecting free cells per inch which contain particulate zirconium and particulate graphite (Barosi et al, U.S. Pat. No. 4,146,497)

Another system for scavenging organic gases is composed of a dissociator and a scavenging pump (Coppola, U.S. Pat. No. 3,221,197). The dissociator may be pyrolytic, catalytic, or it may be an ionizer. The carbon formed by the decomposition of the organic gases deposits on the walls of the apparatus and serves as a scavenging layer for some of the other dissociation products, e.g., fragments of hydrocarbons, carbon monoxide, carbon dioxide, and the like. Molecular filtration is used to remove most organic gases produced and what remains is exposed to a scavenging pump. When hydrogen is the principal residual gas, a pump consisting of a suitable heated material having good hydrogen absorption capability, such as titanium, is recommended. One disadvantage of the system just described in is the contamination of the ionization source, when such is used in the dissociator, by carbon or organic materials.

Amorphous carbon deposits similar to those already mentioned have also been formed from sputtered carbon. (See Plasma Deposited Thin Films, Chapter 4, CRC Press, Inc., Boca Raton, Fla. 1986.)

OBJECTS OF THE INVENTION

It is an object of the present invention to provide a new system for gettering hydrogen and its isotopes.

Another object is to provide a system which will also getter hydrocarbon gases.

Still another object is to provide a pumping device that does not require any catalyst heating.

A further object is to provide a device that can be prefabricated and attached to an existing system to remove hydrogen and hydrocarbon gases.

A still further object is to provide a gettering device that does not require precoating of its gas-absorbing walls.

Yet another object is to proved a gettering device in which the pumping capability is relatively insensitive to the presence of contaminants other than hydrogen and hydrocarbon gases.

Additional objects, advantages, and novel features of the invention will be set forth in part in the description that follows, and in part will become apparent to those skilled in the art upono examination of the following text or may be learned by practice of the invention. The objects and advantages of the invention may be realized and attained by means of the instrumentalities and combinations particularly pointed in the appended claims.

SUMMARY OF THE INVENTION

The invention consists in a new technique for pumping hydrogen, deuterium, and tritium, as well as gaseous hydrocarbons such as methane. The technique consists in striking a plasma discharge with graphite electrodes. The method for striking a discharge is not critical: it can be done by a direct current, radio frequency, or microwave source. The system can be operated over a wide range of pressures. Plasma ions striking the electrodes sputter off carbon atoms and these atoms attract reactive hydrogen ions and atoms created by the discharge and are then deposited on surrounding surfaces to form hydrogen-rich amorphous carbon layers. In the case of pumping hydrocarbon gases, the plasma breaks the hydrocarbon into its elemental constituents, i.e., carbon and hydrogen, and the pumping mechanism described above then proceeds to remove the carbon and the hydrogen.

One set-up that can be used to apply the technique of the invention is a Penning discharge. Its consists essentially of parallel graphite plate cathodes surrounded by electrically isolated concentric shields serving as anodes, and a magnetic field perpendicular to this identical set of electrodes. The resulting device is placed in an evacuated envelope from which it can remove, e.g., hydrogen once a plasma discharge is struck. This particular embodiment, as well as other data concerning the present invention, can be found in the following paper, which is incorporated by reference into this application: Hsu, W. L. and Causey, R. A., "Pumping of hydrogen during plasma-graphite interaction", J. Vac. Sci. Techno. A 5 (4), 2768–2772 July/August 1987.

The hydrogen pumping rate that can be achieved by this technique is large since for every two carbon atoms deposited one hydrogen atom can be removed from the gaseous phase and be trapped in the amorphous carbon layer produced. The pumping rate is therefore determined by the rate of carbon sputtering from the electrodes.

This governing rate can be enhanced in two ways: (1) by increasing the discharge current, and (2) by maintaining the temperature of the graphite electrodes at above 1000° C.

The new technique offers low noise, high capacity, and gas species selectivity. The amount of hydrogen that can be stored in the carbon deposit is very high and, since the process is kinetic, the pumping mechanism can be maintained so long as graphite material is made available to the plasma.

BRIEF DESCRIPTION OF THE DRAWINGS

The accompanying drawings, which are incorporated in and form a part of the specification illustrate an embodiment and some results achieved by the invention and, together with the description, serve to explain the principles of the invention. In the drawings.

DETAILED DESCRIPTION OF THE INVENTION

A new gettering technique has been developed for removing hydrogen, its isotopes, and hydrocarbon gases from evacuated vessels. The technique consists in striking a plasma discharge with a cathode of graphite in an evacuated chamber in which a partial hydrogen pressure ranging from about $10^{-8}$ to several $10^{-1}$ Torr exists. As the plasma ions strike the graphite, carbon atoms are sputtered off the electrode. These carbon atoms then attract the hydrogen atoms created by the discharge and are subsequently deposited on the surrounding chamber walls in the form of a hydrogen-rich amorphous carbon layer.

The plasma source can be any of the conventional means known to the art. Thus the plasma can be created by an axial magnetic field generated by external current coils, or by permanent magnets in a Penning type discharge. The plasma can also be created by a microwave generator, direct current discharge, or an arc discharge.

One set-up that may be used to apply the technique of the invention is a Penning discharge in which the conventional cathodes have been replaced by graphite cathodes. In the type of preferred embodiment, there exists essentially parallel graphite plate cathodes surrounded by electrically isolated concentric shields serving as anodes, and a magnetic field perpendicular to the cathodes. The composition of the anodes is not critical and can consists of any conductive metal or alloy, although stainless steels are generally preferred. As for the cathodes, any commercially available graphite can serve. The resulting device can be placed in any envelope or vessel that need evacuation beyond the capabilities of purely mechanical systems. Once a discharge is struck, as already mentioned, the device efficiently removes hydrogen or hydrocarbon gases from the vessel.

Figure 1:
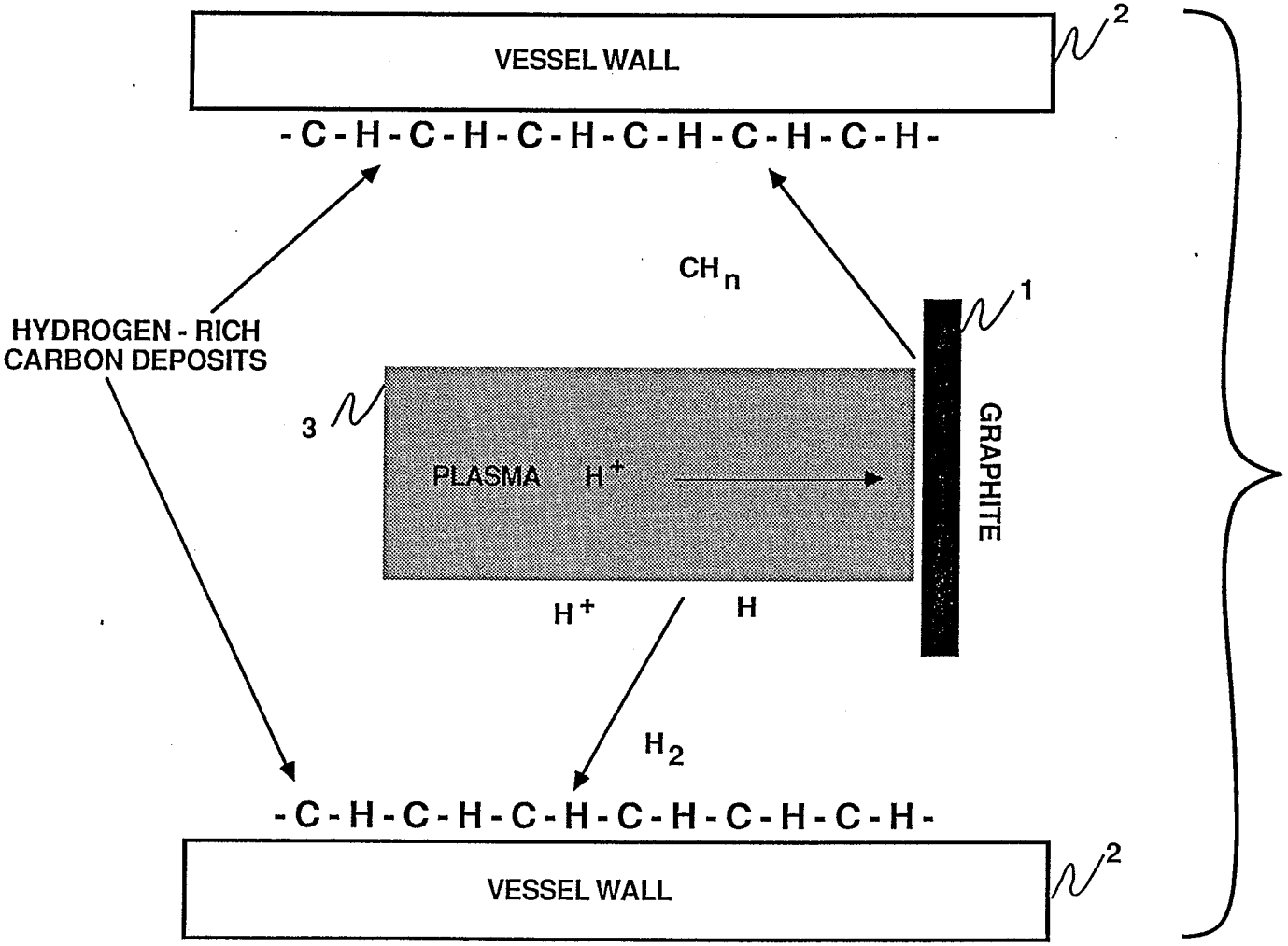
FIG. 1 is a schematic diagram of a simple embodiment of the gettering system of the inventions.

A simpler embodiment of a device of the invention is illustrated schematically in FIG. 1. A graphite electrode 1 is positioned in a closed container, of which only two wall segments 2 are shown. A plasma 3 is struck by an energy source, not shown. The plasma breaks down the hydrogen molecules into atoms and ions. These particles interact with the graphite, eroding it by release of carbon atoms. These in turn combine with the reactive hydrogen atoms and ions to form complex $CH_n$ units which are ultimately deposited on container walls 2 as hydrogen-rich amorphous carbon layers (—C—H—C—H—C—H—C—). A similar mechanism operates when a gaseous hydrocarbon material such as methane is present in the system. In such a case, the methane is broken down into its carbon and hydrogen elemental components and these fragments then proceed to react with each other and with sputtered carbon atoms to yield the hydrogen-rich carbon deposits.

In systems of the types just described, the hydrogen pumping rate is determined by the rate of carbon sputtering from the graphite electrode. That rate can be significantly enhanced by increasing the discharge current, e.g., by running an arc-discharge, or by maintaining the graphite electrodes at a temperature above 1000° C. by means of conventional auxiliary heating equipment. High electrode temperatures have been shown to increase the sputtering yield of graphite by hydrogen by several factors. Usable discharge current densities can range from about 1 to about 1000 mA/cm$^2$.

Figure 2:
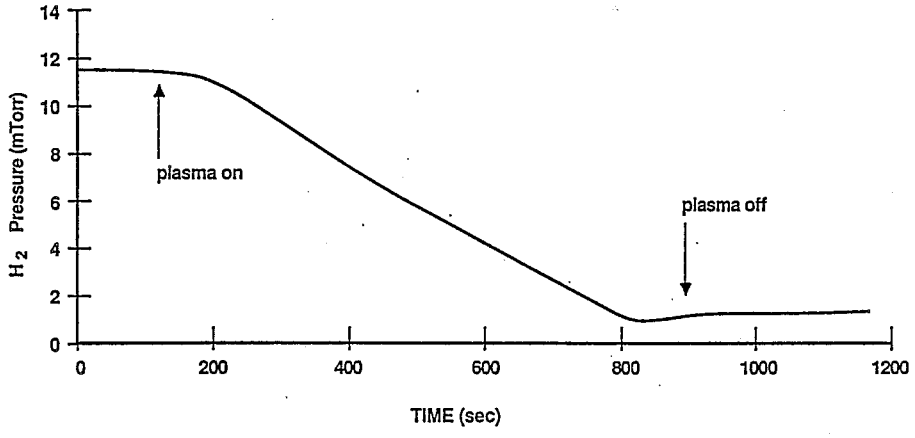
FIG. 2 illustrates the hydrogen pressure decrease that takes place in a closed system during plasma interaction with graphite electrodes.

FIG. 2 graphically illustrates the course of a hydrogen gettering event using a Penning discharge from POCO-AXF-5Q graphite cathodes, as described earlier. As the two-dimensional plot of hydrogen partial pressure in mTorrs (ordinate) against time t, in seconds, (abcissa) shows a constant rate of pressure decrease is established by the discharge. To obtain these results, the system was first pumped down to a base pressure of $2\times10^{-7}$ Torr, the gate valves to the pump were then shut, and hydrogen was fed into the system at t=0 s. Gas feed was stopped after the pressure had risen to about 11 mTorr. The plasma discharge was initiated at t=140 s and the gas pressure immediately began to decrease at a fairly constant rate until termination of the discharge at t=900 s.

A surprising aspect of the data that is shown in FIG. 2 is that the known behavior of hydrogen retention in graphite, in this case retention in the cathodes, could only have led to a substantial underestimation of the quantity of hydrogen that can be pumped from the vessel. At the particular temperature of the graphite substrate in this example, about 600° K., hydrogen diffuses very slowly into the bulk and the near surface of the graphite effectively determines the quantity of hydrogen retained. The near surface region quickly reaches saturation and, therefore, cannot possibly account for the extensive pressure decrease in the system.

Figure 3:
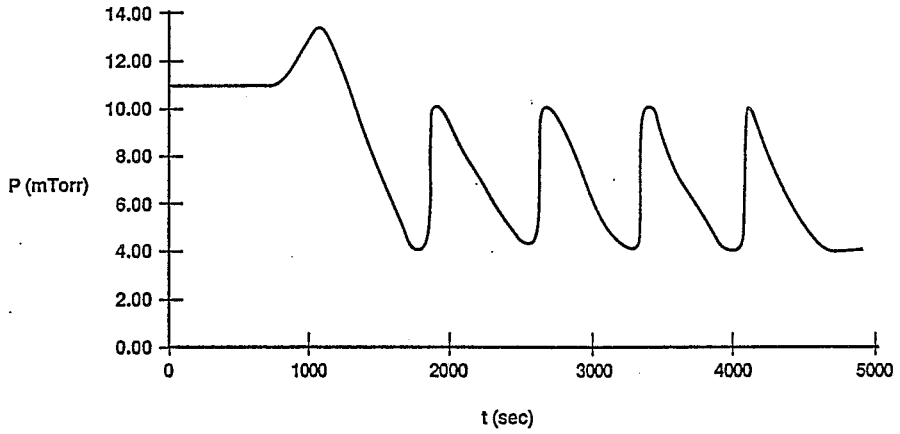
FIG. 3 illustrates the capability of the gettering system of the invention to remove several consecutive charges of hydrogen gas from a closed container.

Another surprising phenomenon observed is that the quantity of hydrogen pumped during the discharge apparently shows no tendency of reaching saturation. This phenomenon is graphically represented in FIG. 3 in which, again, hydrogen partial pressures are plotted against time. The system that produced these data had the following conditions and parameters: volume, 60 liters; cathode area, 40 cm$^2$; current, 1.7 mA/cm$^2$; voltage, 800 V; and cathode, graphite. After initial evacuation to the base pressure of about $1.2\times10^{-7}$ Torr, the hydrogen gas was injected until a pressure of about 11 mTorr was reached. After initiation of the discharge, the hydrogen pressure dropped to about 4 mTorr at t=about 1800 s. At t=about 2000 s, more gas was injected to restore the hydrogen pressure to its original level. The pressure again dropped to about 4 mTorr at t=about 2700 s. As FIG. 3 shows, this pressurization and pumping cycle was repeated three more times, with no sign of saturation being noticed. It can be concluded from such data that the hydrogen pumping phenomenon in an apparatus of this type can persist indefinitely and at a constant rate as long as the supply of graphite electrode is replenished.

In addition to the advantages of the new gettering system that have already been identified, there can be listed several others. For instance, the pumping device can be prefabricated and attached to any existing system from which hydrogen or gaseous hydrocarbons need be removed. The device requires only low cost, easily produced electrodes which can be easily inserted to replace electrodes that have been consumed. The walls of the vacuum system used need not be coated with anything. The geometry of the device can be designed so that the amorphous carbon deposit will form only on auxiliary surfaces, keeping the vacuum system walls unaffected by the operations involved. Finally, as a result of the conditions and reactions of the system, the pumping capability of the new device is relatively insensitive to the presence of contaminants other than hydrogen and gaseous hydrocarbons and, by definition, cannot be poisoned by carbon deposition as can various other types of conventional getters involving ionization sources.

The foregoing description of the invention has been presented for purposes of illustration and disclosure. It is not intended to be exhaustive and to limit the invention to the precise forms disclosed, and obviously many modifications and variations are possible in the light of the above teachings. The embodiments were chosen in order to best explain the principles of the invention and its practical application, and thus enable others skilled in the art to utilize it in various embodiments, with such modifications as might be required by a particular use contemplated. It is intended that the scope of the invention be defined by the following claims.

What is claimed is:

1. A device for gettering hydrogen isotopes and gaseous hydrocarbon within a vacuum or an inert atmosphere, comprising a plasma and graphite as the cathodic material.

2. A device for gettering hydrogen isotopes and gaseous hydrocarbons, comprising:

a hollow vessel, a graphite cathode, an electrically conductive anode, and means for generating a plasma.

3. The device of claim 2 comprising means for heating the cathode.

4. The device of claim 3 wherein the cathode is heated to a temperature greater than 1000° C.

5. The device of claim 2 wherein the cathode consists of two parallel graphite plates.

6. The device of claim 2 wherein the vessel contains auxiliary surfaces for deposition of amorphous carbon.

7. The device of claim 2 wherein the plasma current is within the range of about 1 to about 1000 $mA/cm^2$.

8. The device of claim 2 wherein the plasma is created by an axial magnetic field.

9. The device of claim 1 wherein the anode is a conductive metallic substance.

10. The device of claim 9 wherein the anode is made of stainless steel.

11. A method for gettering hydrogen isotopes and gaseous hydrocarbons, comprising:

inserting a graphite cathode in a hollow vessel, evacuating the vessel by mechanical means, striking a plasma discharge perpendicularly to said cathode, maintaining the discharge until the partial pressure of the hydrogen isotopes or gaseous hydrocarbon levels off.

* * * * *